United States Patent [19]

Ferrini et al.

[11] Patent Number: 4,981,235

[45] Date of Patent: Jan. 1, 1991

[54] UNITARY COUPON DISPENSER

[75] Inventors: Michael G. Ferrini; John Delio, both of Odessa, Tex.

[73] Assignee: Targa Industries, Inc., Odessa, Tex.

[21] Appl. No.: 499,200

[22] Filed: Mar. 22, 1990

Related U.S. Application Data

[63] Continuation of Ser. No. 174,149, Mar. 28, 1988, abandoned.

[51] Int. Cl.[5] ..... B65H 3/00

[52] U.S. Cl. ..... 221/23; 221/39; 221/41; 221/43; 221/1; 271/22; 271/24; 271/25; 271/119

[58] Field of Search ..... 221/23, 22, 13, 39, 221/41, 42, 43, 45, 56, 59, 1; 271/22, 23, 21, 19, 24, 25, 16, 119

[56] References Cited

U.S. PATENT DOCUMENTS

| | | | |
|---|---|---|---|
| 1,458,463 | 6/1923 | Braunstein | 271/23 |
| 1,637,710 | 8/1927 | Rider | 221/22 |
| 1,703,594 | 2/1929 | Pratt | 221/43 X |
| 3,425,685 | 2/1969 | Liva | 271/21 |
| 3,572,691 | 3/1971 | Heinricy | 271/23 |
| 4,039,181 | 8/1977 | Prewer | 221/13 X |
| 4,121,536 | 10/1978 | Chamberlain et al. | 221/13 X |
| 4,154,639 | 5/1979 | Totten | 271/23 X |

*Primary Examiner*—David H. Bollinger
*Attorney, Agent, or Firm*—Marcus L. Bates

[57] ABSTRACT

A dispenser for sequentially dispensing one sheet at a time from a stack of sheets. A housing encloses a drive and a lift roller, and each roller has a longitudinal axis arranged in parallel aligned relationship respective to one another and spaced from the one another an amount to bring the outer peripheral surfaces thereof into rolling contact with one another. A holding post is aligned in parallel relationship with respect to the rollers and is spaced therefrom for enabling a stack of sheets to be held against the holding post and lift roller, with one outermost sheet having a marginal edge portion thereof urged against the lift roller and the opposed marginal edge portion thereof is urged against the holding post. The outer peripheral surface of the drive roller is made of high friction material while the lift roller has a relatively small segment of its outer peripheral surface made of high friction material and the remainder of the peripheral surface made of low friction material. The low friction material has a co-efficient of friction which is less than the surface of the sheet while the high friction material is greater than the co-efficient of friction of the surface of the sheet. The drive and lift rollers engage one marginal end of the outermost sheet which is lifted by the roller and thereafter transferred by the lift roller to a location between the drive and lift rollers which jointly engage and transport the sheet to an opposed side of the rollers to a station while concurrently pulling the sheet from between the stack and post.

17 Claims, 3 Drawing Sheets

FIG. 1
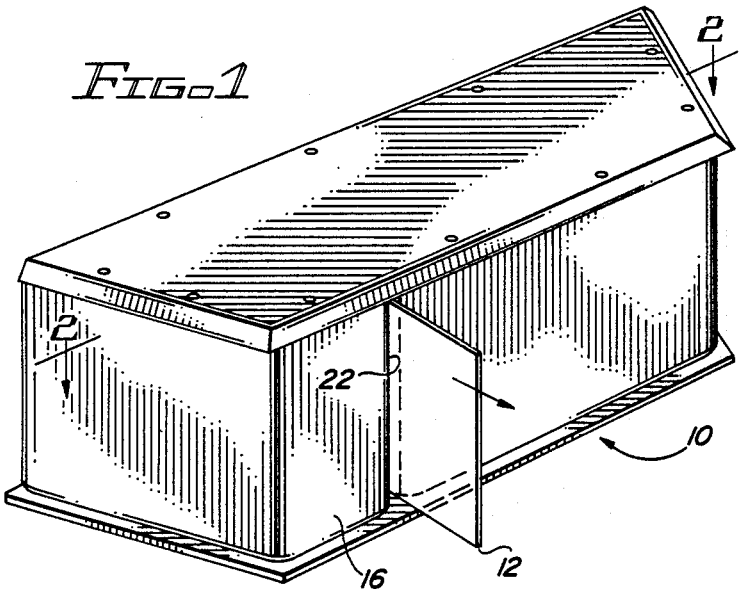
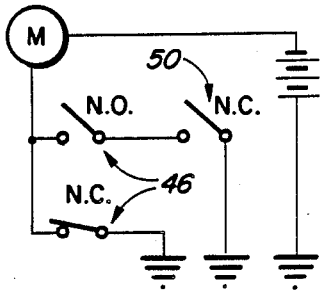
FIG. 4
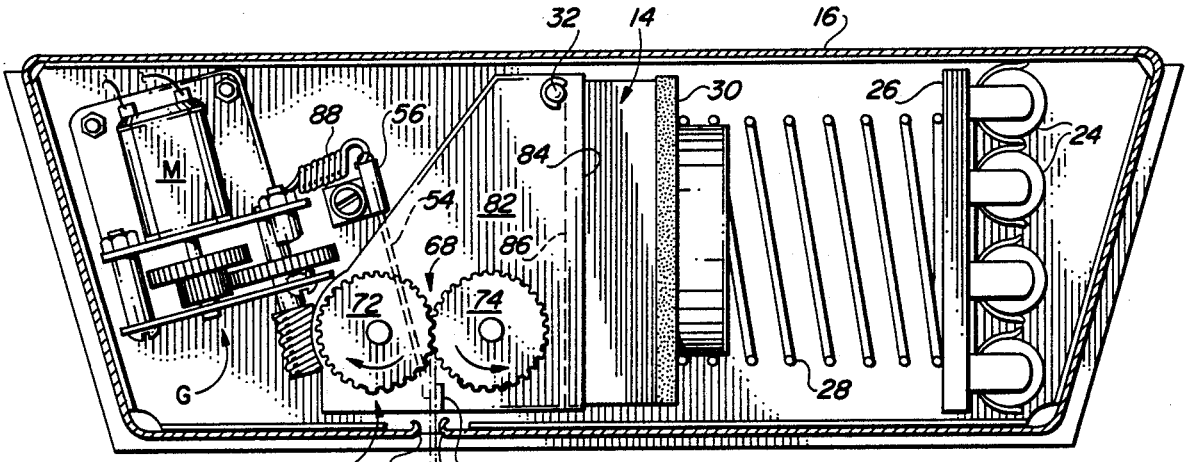
FIG. 2
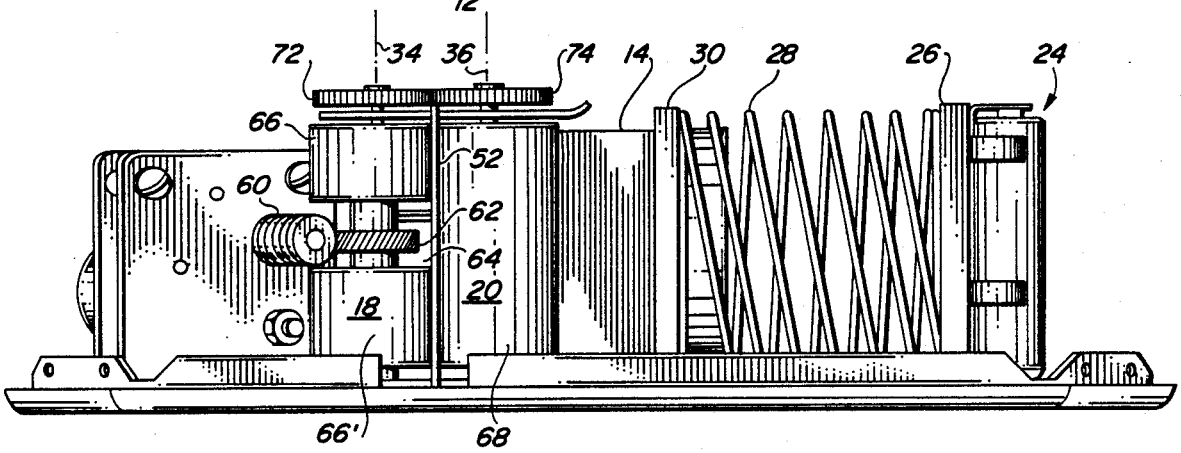
FIG. 3

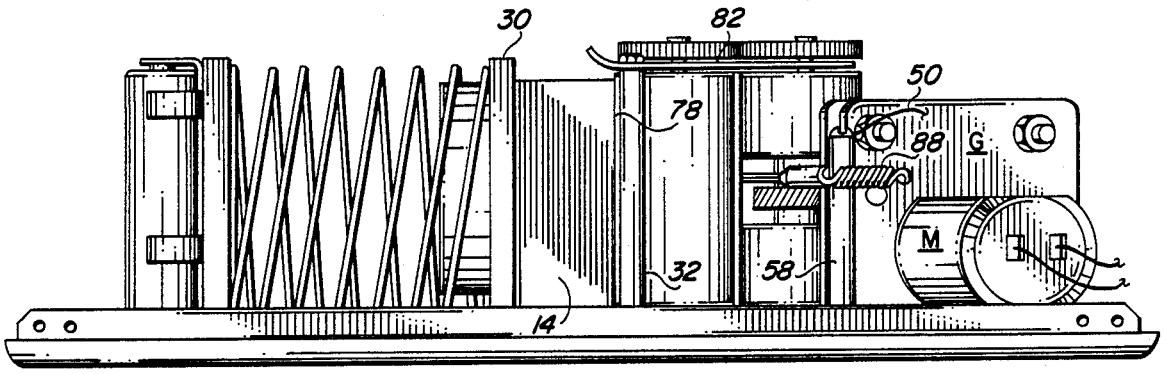
FIG. 6
| | | COUPON WAITING | COUPON REMOVED | ROTATION + 15° | ROTATION + 70° | ROTATION +360° | NO MORE COUPONS @ START POSITION |
|---|---|---|---|---|---|---|---|
| SW1 | A | ○ | ○ | ● | ● | ○ | ○ |
| | | | | | | | |
| SW2 | | ● | ● | ● | ● | ● | ○ |
| SW3 | | ○ | ● | ● | ○ | ○ | ○ |
| | | | | | | | |
● CLOSED
○ OPEN
FIG. 7
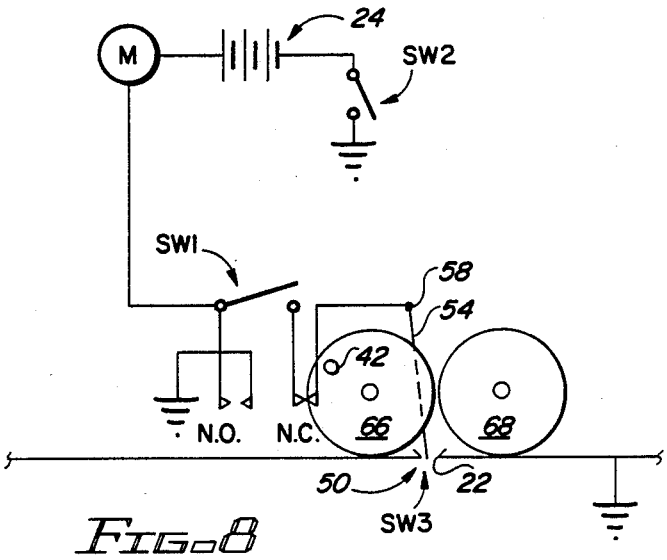
FIG. 8

UNITARY COUPON DISPENSER

This is a continuation of application Ser. No. 07/174,149, filed Mar. 28, 1988 now abandoned.

BACKGROUND OF THE INVENTION

An important aspect of marketing is the use of coupons that can be redeemed while grocery shopping, for example. The coupons usually appear in newspapers and magazines and provide a small reduction in price when the goods and coupons are presented to the grocery clerk. This is offensive to many people who do not have the time available for clipping coupons from publications and saving them until the next shopping trip. Accordingly, the present invention provides a means by which all of the customers can obtain their coupons at the same location in the store that displays the desired goods.

It may appear to some people that this same goal could be achieved by merely nailing a handful of coupons to the store shelf so that the customers could retrieve the coupons one at a time from the stack of coupons. However, when this has been tried in the past, the coupons invariably become torn or multilated and litter the floor, or a customer will take unfair advantage and retrieve more than one coupon from the stack.

It would therefore be desirable to be able to provide a tampered proof enclosure within which coupons are stacked and transferred from the stack to a location outside of the enclosure where the coupon is presented to the customer one at a time. Moreover, it would be desirable that a considerable time delay occur between the sequentially delivered coupons so as to discourage the customer from taking more than one coupon. Furthermore, it would be desirable that the coupon dispenser attract the attention of the customer so that he will be induced to purchase the goods associated with the coupon.

Apparatus that overcomes the above drawbacks and provides some of the desirable aspects enumerated above is the subject of the present invention.

SUMMARY OF THE INVENTION

A dispenser for sequentially dispensing one sheet at a time from a stack of sheets. The dispenser has a main housing within which there is rotatably supported a pair of rollers that make rolling contact with one another and are arranged in parallel aligned relationship respective to one another. One roller is a lift roller while the other is a drive roller. A holding post is aligned in parallel relationship respective to the axis of the rollers and spaced therefrom. Means are provided for holding a stack of sheets against the holding post and the lift roller. The outermost sheet of the stack has a marginal edge portion that is urged against the lift roller and an opposed marginal edge portion that is urged against the holding post.

The outer surface of the drive roller is made of high friction material. The outer surface of the lift roller has a segment thereof made of high friction material with the remainder of the outer peripheral surface thereof being made of low friction material. The low friction material has a co-efficient of friction which is less than the surface of the sheet. The high friction material has a co-efficient of friction which is greater than the surface of the sheet. Means are provided for rotating the drive and lift rollers in timed relationship respective to one another.

The lift roller, when rotated, engages the outermost sheet which is lifted and buckled; and, the end of the sheet thereafter is transferred by the lift roller to a location between the drive and lift rollers. A combination guide and switch means guides the leading edge of the sheet between the drive and lift rollers which transports the sheet from the feed side of the rollers to the discharge side of the rollers.

The switch contacts receive the sheet of material therebetween and holds the sheet of material until it is retrieved by a person. The guide means and switch means guide the sheet between the contacts of the switch, and a cam actuated switch causes the motor to be de-energized toward the end of each cycle of operation.

The cam actuated switch means is responsive to the position of the drive and lift rollers. This second switch means is actuated by a cam located on one of the rollers and is connected to supply the motor with current when the contacts of the guide switch means has been closed, and is also arranged to de-energize the motor at the appropriate time.

Therefore, in normal operational mode, the apparatus is in standby configuration with a sheet being held in a position to be retrieved by a person. When the sheet is pulled from the combination guide and switch means, the contacts of the switch means close, thereby energizing the motor which rotates the drive and lift rollers. This action transfers the next sheet from the stack into the feed side of the rollers where the sheet is transferred to the delivery side of the rollers and between the switch contacts. The second switch means continues to energize the motor to move the sheet until the second switch means is opened by the cam located on the rollers.

Accordingly, a primary object of the present invention is the provision of a dispenser that transfers sheets one at a time from a stack of sheets.

Another object of the present invention is the provision of a coupon dispenser that employs only two rollers having the axis thereof fixed respective to the apparatus and arranged respective to a stack of sheets to transfer the sheets one at a time from a feed side of the rollers to a discharge side of the rollers.

A further object of this invention is the provision of method and apparatus for sequentially dispensing sheets from a stack comprising holding the stack against a support roller and a lift roller, and making the roller surface of a material that lifts the next available sheet and thereafter transfers the leading edge of the sheet into the feed side of the two rollers where the rollers then transfer the sheet to the discharge side of the rollers, whereupon the sheet is stored until it is retrieved, and at that time the cyclic operation is repeated.

Another and still further object of this invention is the provision of apparatus for sequentially dispensing sheets from a stack comprising only two rollers which include a lift roller and a power roller; and a support spaced therefrom. The stack is urged against the lift roller and the support, and the rollers are timed respective to one another and rotated jointly whenever another sheet needs to be advanced. The lift roller has the surface thereof made of high friction material and low friction material arranged in a manner whereby during rotation the low friction roller material does not move the sheet and when the high friction material engages the sheet, the sheet is lifted and thereafter the leading edge of the high friction material moves the edge of the sheet circumferentially about the roller and guided between the rollers where the two rollers transport the sheet to a station where the sheet can be retrieved.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

BRIEF DESCRIPTION OF THE DRAWINGS

FIG. 1 is a perspective view of a coupon dispenser made in accordance with the present invention;

FIG. 2 is a cross-sectional view of the coupon dispenser taken along line 2—2 of FIG. 1;

FIG. 3 is a front, elevational view of the apparatus disclosed in FIG. 2;

FIG. 4 is a schematical representation of circuitry used in conjunction with the foregoing apparatus;

FIG. 6 is a rear, elevational view of the side opposite of the apparatus disclosed in FIG. 3;

FIG. 7 is a diagrammatical representation showing the operative relationship of a number of switches associated with the invention; and, FIG. 8 is an alternate embodiment of the circuitry shown in FIG. 4.

DETAILED DESCRIPTION OF THE PREFERRED EMBODIMENT

Figure 5A:
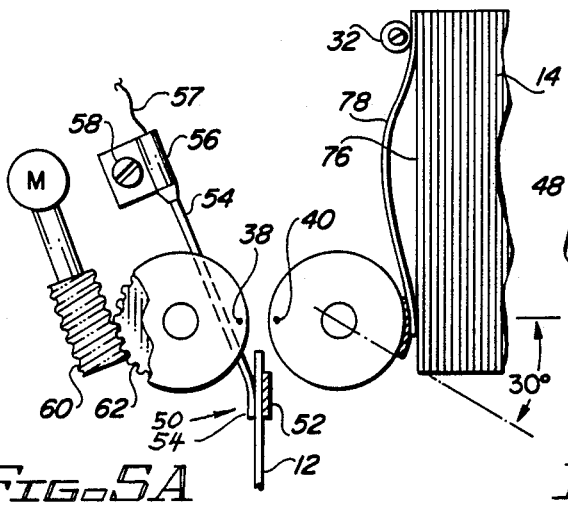
FIGS. 5A–5F are broken, part diagrammatical, part schematical, representations of the apparatus disclosed in the foregoing figures.

In the Figures of the drawings there is disclosed a dispenser 10 for sequentially dispensing one sheet 12 at a time from a stack 14 of sheets. The sheet 12 will also be referred to herein as a coupon. The apparatus includes an external housing 16 having the illustrated vertical slot formed therein through which a coupon 12 is partially extended until a person retrieves the coupon, whereupon another coupon will ultimately emerge through the slot and remain supported therein until that coupon is also retrieved. This action will continue until the supply of coupons has almost been exhausted.

Within the main housing there is rotatably journaled a drive roller 18 and a lift roller 20. The rollers, 18 and 20, are arranged in parallel aligned relationship respective to one another and spaced from one another an amount to bring the outer peripheral surfaces thereof substantially into rolling contact with one another.

Numeral 22 indicates the before mentioned vertical slot through which a coupon 12 is extended. A battery pack 24 comprises the illustrated four "AA" cells connected in series and secured in the illustrated position by appropriate commercially available battery clips.

A vertical back plate 26 is rigidly affixed to the main housing and provides a vertical support for the battery pack 24. The plate 26 also receives a coil spring 28 thereagainst. A vertical pressure plate 30 is spaced from back plate 26 and the compression spring 28 is captured there between. The vertical plate 30 can move toward and away from plate 26, and is biased against the stack by the compression of spring 28.

A holding post 32 in the form of a vertical standard is aligned in parallel relationship respective to the axis of the rollers 18 and 20 and is spaced therefrom. The opposed marginal edges of one side of the stack 14 of sheets 12 is held against the holding post and lift roller. More specifically, the outermost sheet of the stack has a marginal edge portion thereof urged against the lift roller and the opposed marginal edge portion urged against the holding post. Numeral 34 indicates the centerline or vertical axis of the power roller. Numeral 36 indicates the centerline or vertical axis of the lift roller. Timing marks 38 and 40, respectively, are placed on the power and lift rollers 18 and 20, respectively. The lowermost surface of the power roller is provided with a cam 42 which actuates switch actuator arm 44 of micro-switch 46. The switch 46 a double pole, double throw switch known to those skilled in the art and commercially available from a number of sources.

Figure 5B:
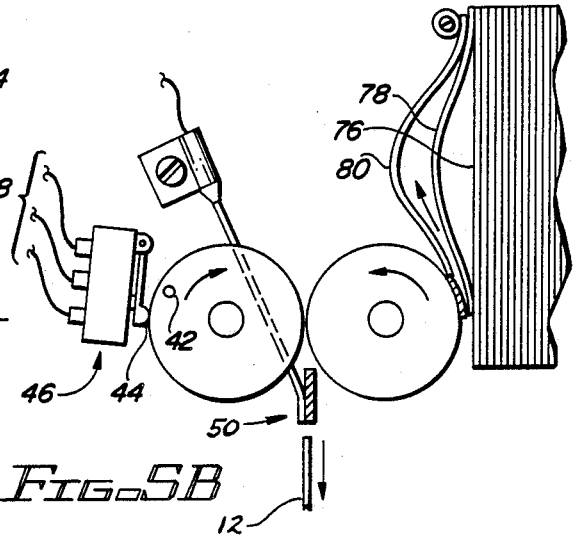
Figure 5C:
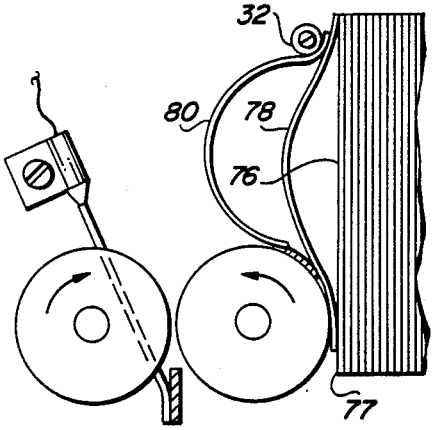
Figure 5D:
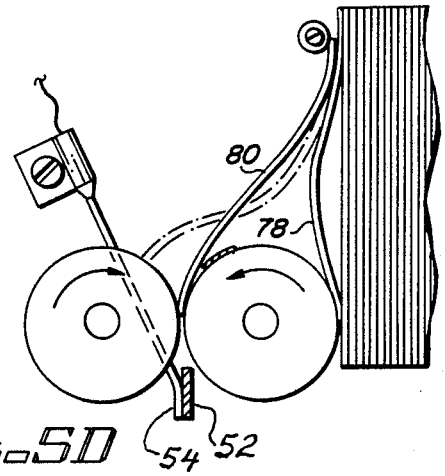
Figure 5E:
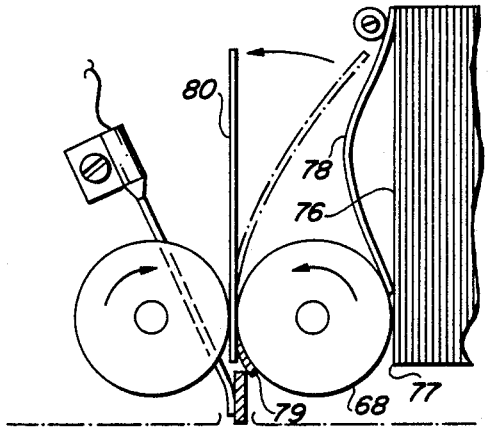
Figure 5F:
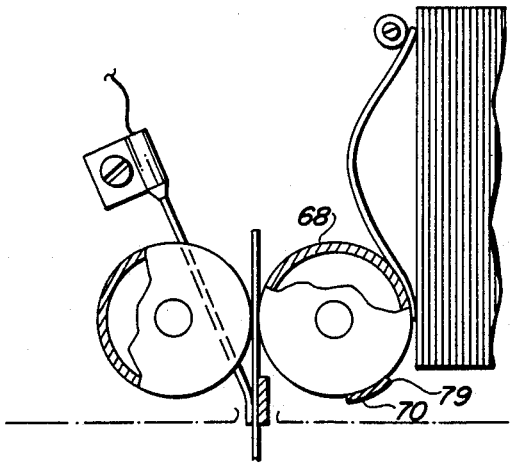

The three electrical conductors at 48 in FIG. 5 are connected to the contacts of the micro-switch, and are connected to the remaining circuitry in the illustrated manner of FIG. 4. It will be noted in FIGS. 3 and 4 of the drawings that the power roller has a medial portion thereof reduced in diameter to provide a tunnel through the rollers through which part of a combination switch and guide 50 can extend.

A vertical guide 52 is grounded to the chassis and aligned parallel to the axis 34, 36 of the rollers. An elongated whisker switch member 54 forms an electrical contact at the free end thereof with the vertical guide 52. The whisker member 54 has a fixed end at 56 which is insulated from ground and connected to wire 57. Anchor post 58 supports the fixed end of the elongated contact 54. The free end of the switch arm 54 makes electrical contact with the guide 52 and the contacts are separated or moved into the open configuration when a sheet 12 of material is moved into captured relationship therebetween. Compare FIGS. 5A and 5B. Hence, the switch and guide member 50, together with the slot 22, provide a plurality of unique and unexpected functions, including the provision of a holding station where the coupon 12 is held until retrieved.

A worm drive gear 60 is meshed with a driven gear 62, with numeral 64 indicating the tunnel through which the elongated arm 54 of the combination contact and guide 50 extends. The outer peripheral surface 66 of the power roller is provided with high friction material 360 degrees about the outer surface thereof.

The outer peripheral surface 68 of the lift roller is provided with a low friction or slick surface for approximately 330° of its circumference and a high friction surface 70 for approximately 30° of its outer peripheral surface. The slick surface 68 preferably extends 320°–345° about the circumference of the roller, while the high friction surface 70 extends 40°–15° about the circumference of the roller. Gear 72 is arranged to rotate power roller 18 while gear 74 is arranged to rotate lift roller 20.

In FIGS. 5A–5F, a first sheet 76 is pressed against the stack 14. Numeral 78 indicates a lifted or buckled sheet. Numeral 80 indicates a sheet that has been lifted and is in the process of being fed into the pinch that is formed between the co-acting rollers.

In operation, the coupons 12 are stacked in place at 14 between member 30 on one side thereof and members 20, 32 on the opposed side thereof. A coupon or a temporary piece of paper is placed between the contacts 52, 54 to de-energize the motor M. The cover 16 is attached in place, and the dispenser is now ready to be used and can be appropriately mounted in a selected area, preferably adjacent the goods to be redeemed by the coupon 12.

Removal of the dispensed coupon 12 from between contacts 50 closes the contacts and energizes the system. At this time, closure of the contacts at 50 causes current flow from the source or current supply 24, to the motor M, through the normally open contacts (now closed) of the micro-switch 46, and to ground. Hence, the normally open contacts of the micro-switch (which are closed by the cam) and the normally closed contacts 50 of the guide switch (which is opened by the coupon) completes the circuitry when the apparatus is in the configuration of FIG. 5A with the coupon removed from contacts 50. The rotation of the rollers moves cam 42 which moves the micro-switch into the alternate position, thereby moving the switch contacts into the position illustrated in FIG. 4. The normally closed contacts of switch 46 now supplies the motor with current until cam 42 again moves arm 44 of micro-switch 46 into the alternate configuration so that the normally closed ground switch is opened and the normally open switch is closed, thereby providing current flow to the open switch contacts 50. At this time, switch 50 is opened because a coupon has been received between contacts 52, 54. When the coupon is removed, contacts 52, 54 are closed and motor M is energized through the normally open contacts of switch 46 and the normally closed contacts of switch 50.

The motor M will now rotate the rollers 18, 20 one revolution. The first revolution lifts the first sheet 76 into the buckled configuration 78 of FIG. 5A. The next rotation brings the leading edge or shoulder 79 of the high friction material 70 into contact with the near end of sheet 78, thereby moving the free marginal end of sheet 78 from the illustrated position of 78 into position 80 where the sheet is guided by switch arm 54 into the pinch formed between the counter-rotating rollers 18, 30. The coupon is forced by the action of the rollers therethrough and the leading marginal edge of the coupon is forced through the contacts 52, 54. This action moves the normally closed switch 50 into the open position. At this time, the normally closed switch of micro-switch 46 continues operation of the motor until cam 42 moves arm 44 and the normally closed switch of 46 is moved to the open position while the normally open switch thereof is closed. At this time, the rollers have pulled the far marginal end of the coupon from the post as the roller thereafter moves the trailing marginal end of the coupon to a position between the contacts of switch 50, the rollers stop rotation and the coupon is held in position within slot 22 where it is available waiting for someone to retrieve it.

The apparatus will remain in this dormant or standby configuration until someone retrieves the sheet 12, whereupon contacts 52, 54 are again closed causing the above operation to be repeated.

An important novel part of this invention is the cooperative action between members 26, 30 and the stack 14, along with the selected capacity of the batteries. As the coupons are dispensed and only the last few coupons remain in stack 14, member 30 will move into contact with edge 84 of the upper frame 82 which serves as a stop member to prevent member 30 from coming into contact with post 32 and roller 20. This relieves the pressure on the remaining few coupons, and since the coupons are not pressed against roller 20 and member 32, the last few sheets will not be fed between rollers 18, 20. At this time, switches 46, 50 will be supplying current to motor M and the batteries at 24 will accordingly continue to run the motor until the batteries are discharged.

Four nickel Cadium batteries of "AA" size will be nearing the end of one of their life cycles at this time, and it is desirable that this battery be fully discharged before being recharged so that the battery memory will not effectively shorten the capacity of the battery. Stated differently, the batteries need to be deep-cycled each time they are discharged so that the next cycle will make available slightly more than adequate power for again cycling the novel dispenser a sufficient number of times to enable all but the last few of the sheets to be retrieved.

In one specific embodiment of the invention the following was used: the material on outer surface 18 is close cell neoprene, the material on outer surface 20 is acetate, the spring force 28 is 1.2 lbs., the number of sheets in stack 14 is 1–625, the number of seconds between sequentially delivered sheets is about six, the diameter of roller 18 is 1", and the diameter of roller 20 is 1", motor model Mabuchi FT-36D, gear ratio 80-1; physical dimension of the individual sheets of stack 14 3"×1-15/16", and the distance between axis 36 and axis of 32 2.2".

Those skilled in the art, having fully digested the present disclosure, will appreciate that this invention broadly comprehends a dispenser 10 for sequentially dispensing one sheet 12 at a time from a stack 14 of sheets. A main housing 16 is attached to a chassis which rotatably supports a drive roller 18 and a lift roller 20, each roller having a longitudinal axis 34 and 36 arranged in parallel aligned relationship respective to one another and spaced from one another an amount to bring the outer peripheral surfaces thereof into rolling contact with one another; means 32 in the form of a holding post is aligned in parallel relationship with respect to the axis of said rollers and spaced therefrom; means 28, 30 are provided for holding a stack of sheets against said holding post and lift roller with one outermost sheet 78 having a marginal edge portion thereof urged against said lift roller and the opposed marginal edge portion thereof urged against said holding post. The outer peripheral surface 66 of said drive roller is made of high friction material; while the lift roller has a relatively small segment 70 of its outer peripheral surface made of high friction material and the remainder 68 of the peripheral surface made of low friction material. The low friction material has a co-efficient of friction which is less than the co-efficient of friction of the surface of the sheet while the high friction material is greater than the co-efficient of friction of the surface of the sheet; and means M and G are provided for rotating said drive and lift rollers; whereby, the lift roller engages one marginal end of the outermost sheet which is lifted by the roller and thereafter transferred by the lift roller to a location between the drive and lift rollers which jointly engage and transport the sheet to an opposed side of the rollers to a station while concurrently pulling the sheet from between the stack and post.

Circuitry (FIG. 4) is included by which the cyclic operation of the apparatus is automatically controlled in a novel manner and includes a cam operated switch 46 in cooperation with a combination guide and feed switch which energize the motor and automatically sequentially feed the sheets to a station where they are retrieved one at a time.

FIG. 7 is a schematical representation that illustrates the cooperative action of the switches SW1, SW2, and SW3 of FIG. 8. As seen in FIG. 8, SW1 is the double pole, double throw (D.P.D.T.) switch 46 of FIG. 5B; SW2 is a micro switch that bears against member 30 and is moved to the closed position whenever the stack of coupons is placed in the illustrated manner of FIGS. 2, 3, and 6. SW3 is switch 50 of FIGS. 2 and 5A.

We claim:

1. A dispenser for sequentially dispensing one sheet at a time from a stack of sheets, comprising:

a main frame to which there is rotatably journaled a drive roller and a lift roller, the drive and lift rollers each having a longitudinal axis arranged in parallel aligned relationship respective to one another and spaced from one another an amount to substantially bring the outer peripheral surfaces thereof into rolling contact with one another;

a holding member aligned in parallel relationship with respect to the axis of the drive and lift rollers and spaced therefrom; means for holding a stack of sheets against said holding member and against said lift roller with an outermost sheet of the stack having a marginal end portion thereof urged against said lift roller and an opposed marginal end portion thereof urged against said holding member;

the outer peripheral surface of said drive roller is made of high friction material; said lift roller has a relatively small segment of its outer peripheral surface made of high friction material and the remainder of the peripheral surface made of low friction material, said low friction material has a co-efficient of friction which is less than the co-efficient of friction required to buckle a sheet while the co-efficient of friction of said high friction material is of a value respective to the co-efficient of friction of the surface of the sheet to cause the small segment of the lift roller to buckle the sheet during rotation of the lift roller; means rotating said drive and lift rollers;

a shoulder formed between the high and low friction materials of the lift roller for engaging one end of a sheet that has been buckled and thereby moves the end of the sheet toward the contacting surfaces of the drive and lift rollers, whereupon the sheet is received between the rollers and is thereby pulled from the stack;

said shoulder of said lift roller being positioned to engage one edge of an outermost sheet which has been buckled and, upon continued rotation of the lift roller, thereafter transfers the sheet to a location between the drive and lift rollers which jointly engage and move the outermost sheet to an opposed side of the rollers and to a station where the sheet can be retrieved while concurrently pulling the next outermost sheet from between the stack and holding member.

2. The dispenser of claim 1 wherein said means rotating said drive and lift rollers is an electric motor connected to rotate said rollers, circuitry including a first and second switch means connecting said motor to a power supply; the first switch means has normally open switch contacts; said second switch means has normally closed switch contacts connected to energize said motor when the sheet is retrieved and to de-energize said motor when the sheet has passed through the rollers; means on one of said rollers for actuating said first switch in timed sequence with the position of the sheet to provide a current flow path from the power supply, to the motor, through the switch contacts of the second switch means, and back to the power supply.

3. The dispenser of claim 1 wherein an electric motor provides the means rotating the rollers, and a switch means having a vertical guide and whisker biased into electrical contact are attached to the main frame with the contacts thereof being positioned at the discharge side of the rollers; one of the rollers has a reduced diameter medial portion that forms a tunnel between said rollers through which said whisker of the switch means extends into contact with said vertical guide; and the sheet is received between the whisker and vertical guide and thereby opens the contact between the whisker and vertical guide and de-energizing said motor.

4. The apparatus of claim 3 wherein there is another switch means connected to provide a current flow path to the motor when the first recited switch means is open by providing a current flow path that circumvents the first recited switch means so that current is available to energize the motor for one complete cycle of operation.

5. A dispenser for sequentially dispensing one sheet at a time from a stack of sheets, comprising:

a main frame to which there is rotatably journaled a drive roller and a lift roller, the drive and lift rollers each having a longitudinal axis arranged in parallel aligned relationship respective to one another and spaced from one another an amount to substantially bring the outer peripheral surfaces thereof into rolling contact with one another;

a holding member aligned in parallel relationship with respect to the axis of the drive and lift rollers and spaced therefrom; means for holding a stack of sheets against said holding member and against said lift roller with an outermost sheet of the stack having a marginal end portion thereof urged against said lift roller and an opposed marginal end portion thereof urged against said holding member;

the outer peripheral surface of said drive roller is made of high friction material; said lift roller has a relatively small segment of its outer peripheral surface made of high friction material and the remainder of the peripheral surface made of low friction material, said low friction material has a co-efficient of friction which is less than the co-efficient of friction required to buckle a sheet while the co-efficient of friction of said high friction material is of a value respective to the co-efficient of friction of the surface of the sheet to cause the small segment of the lift roller to buckle the sheet during rotation of the lift roller; means rotating said drive and lift rollers;

a shoulder formed between the high and low friction materials of the lift roller for engaging one end of a sheet that has been buckled and thereby moves the end of the sheet toward the contacting surfaces of the drive and lift rollers, whereupon the sheet is received between the rollers and is thereby pulled from the stack;

said shoulder of said lift roller being positioned to engage one edge end of an outermost sheet which has been buckled and, upon continued rotation of the lift roller, thereafter transfers the sheet to a location between the drive and lift rollers which jointly engage and move the outermost sheet to an opposed side of the rollers and to a station where the sheet can be retrieved while concurrently pulling the next outermost sheet from between the stack and holding member;

said rotating means include an electric motor; a switch means is connected to energize said motor when the sheet is retrieved and to de-energize said motor after most of the sheet has passed through the rollers.

6. The dispenser of claim 5 wherein said switch means is arranged to provide electrical switch contacts and to guide the sheet between the rollers and thereafter to receive the sheet from the rollers between the switch contacts thereby moving said switch means to the open position so that when the dispensed sheet is retrieved, the switch is closed which energizes the motor and transfers the next available sheet to a location between the switch contacts.

7. The dispenser of claim 6 wherein said means rotating said drive and lift rollers is an electric motor, said switch means having one switch contact in the form of an elongated whisker and another contact in the form of a vertical guide attached to the main frame at the discharge side of the rollers; one of the rollers has a reduced diameter medial portion that forms a tunnel between said rollers through which said whisker extends into contact with said vertical guide; and the sheet is received between the whisker and vertical guide and thereby opens the switch contacts of the whisker and vertical guide.

8. A dispenser for sequentially dispensing one sheet at a time from a stack of sheets, comprising:

a main frame to which there is rotatably journaled a drive roller and a lift roller, each roller having a longitudinal axis arranged in parallel aligned relationship respective to one another and spaced from one another an amount to substantially bring the outer peripheral surfaces thereof into rolling contact with one another;

a holding member aligned in parallel relationship with respect to the axis of said rollers and spaced therefrom; means for holding a stack of sheets against said holding member and lift roller with one outermost sheet having a marginal edge portion thereof urged against said lift roller and the opposed marginal edge portion thereof urged against said holding member;

the outer peripheral surface of said drive roller is made of high friction material; said lift roller has a relatively small segment of its outer peripheral surface made of high friction material and the remainder of the peripheral surface made of low friction material, said low friction material has a co-efficient of friction which is of a value not to buckle the sheet while said high friction material is of a value to engage the surface of the sheet and cause it to buckle; an electric motor means for rotating said drive and lift rollers;

said high friction material of said lift roller presents an edge and is positioned to engage one marginal end of the outermost sheet after the sheet is buckled by the high friction material of the lift roller and thereafter guides the sheet to a location between the drive and lift rollers which jointly engage and transport the outermost sheet to an opposed side of the rollers and to a station where said sheet can be retrieved; while concurrently pulling the outermost sheet from between the stack and holding member;

circuitry including a first and second switch means for connecting said motor to a power supply; said first switch means having normally open switch contacts and said second switch means having normally closed switch contacts; said second switch means is connected to energize said motor when the sheet is retrieved and to de-energize said motor when the sheet has passed through the rollers; means on one of said rollers for actuating said first switch means in timed sequence with the position of the sheet to provide a current flow path from the power supply, and to the motor.

9. The dispenser of claim 8 wherein said normally closed switch means is arranged to provide electrical switch contacts and to guide the sheet between the rollers and thereafter to receive the sheet from the rollers between the switch contacts thereby moving the switch to the open position so that when the dispensed sheet is retrieved, the switch is moved to the closed position which energizes the motor and transfers the next available sheet to a location between the switch contacts.

10. The dispenser of claim 9 wherein said normally closed switch has one switch contact in the form of an elongated whisker and the other contact is a vertical guide attached to the main frame at the discharge side of the rollers; one of the rollers has a reduced diameter medial portion that forms a tunnel between said rollers through which said whisker of the guide switch extends into contact with said vertical guide; and the sheet is received between the whisker and vertical guide and thereby opens the contact between the whisker and vertical guide.

11. Apparatus for dispensing sheets of material one at a time from a stack to a station where the sheet can be retrieved; said apparatus includes a main body, a drive roller, and a lift roller; the drive and lift rollers are journaled for rotation about an axis that is fixed respective to said main body;

said drive roller and said lift roller have a central axis parallel to one another and spaced to bring the peripheral surfaces thereof into rolling contact with one another; an upright abutment means arranged to receive one of the opposed marginal ends of one side of the stack of sheets thereagainst while the other of the marginal ends of the stack bears against said lift roller; the lift and drive rollers have a feed side and a discharge side; said station is located at the discharge side of the rollers where one end of a sheet is transferred and held until it is retrieved; means rotating said drive and lift rollers to move a sheet from the stack and place an end of the sheet at the feed side of the rollers where the sheet is moved from the feed side to the discharge side of the rollers;

a shoulder formed between the high and low friction materials of the lift roller for engaging one end of a sheet that has been buckled and thereby moves the end of the sheet toward the contacting surfaces of the drive and lift rollers, whereupon the sheet is received between the rollers and is thereby pulled from the stack;

a segment of the circumference that forms the outer periphery of said lift roller is made of high friction material for engaging and buckling the outermost sheet upon rotation of the lift roller and thereafter, upon further rotation of said lift roller, said shoulder engages and transfers the sheet to the feed side between the drive and lift rollers which jointly engage and transport the sheet to an opposed side of the rollers as the sheet is pulled from between the stack and abutment means, where the sheet can be retrieved at the station.

12. The dispenser of claim 11 wherein said means rotating the rollers includes an electric motor connected to counter-rotate said rollers, circuitry including a first and second switch means connecting said motor to a power supply; said first switch means having normally open switch contacts; said second switch means having normally closed contacts and is connected to energize said motor when the sheet is retrieved and to de-energize said motor after the sheet has passed through the rollers; means on one of said rollers for actuating said first switch means in timed sequence with the position of the rollers to provide a current flow path from the power supply to the motor, to force most of the sheet to travel through the rollers and to the station.

13. The dispenser of claim 12 wherein said second switch means having contacts comprising a vertical plate and a whisker biased into electrical contact therewith and are attached to the main frame at the discharge side of the rollers; one of the rollers has a reduced diameter medial portion that forms a tunnel between said rollers through which said whisker of the second switch means extends into contact with said vertical plate; and the sheet is received between the whisker and vertical plate and thereby breaks electrical contact between the whisker and vertical plate.

14. Method of dispensing sheets of material one at a time from a stack comprising the steps of:

supporting a pair of rollers on a main frame with the rollers having counter rotating surfaces thereof arranged in aligned relationship and in close proximity to one another to force a sheet therethrough during rotation of the rollers; and, supporting a stack of sheets of material on said main frame;

selecting substantially all of the outer peripheral surface of one roller of said pair of rollers from a relatively high co-efficient of friction material;

dividing the outer peripheral surface of the other roller of said pair of rollers into a large and a small segment and selecting the surface of the large segment from a relatively low co-efficient of friction material which will not buckle a sheet; and, selecting the surface of the small segment from a relatively high co-efficient of friction material which will lift and buckle a sheet; mounting the high friction and low friction material in fixed relationship respective to one another;

mounting an upright member in spaced relation respective to the rollers; and urging the opposed marginal ends of the outermost sheet of the stack of sheets against said other roller and against said upright member;

positioning the high friction material adjacent the low friction material on said other roller and forming a shoulder at the leading edge of said high friction material; whereby the high friction surface on said other roller engages and buckles a sheet on rotation of the rollers and on continued rotation the shoulder of the other roller engage an edge of the lifted sheet and upon further rotation of the rollers transfers the sheet to the pinch between the rollers, where continued rotation of the rollers transfers a sheet from the feed side to the discharge side of the rollers for retrieval.

15. The method of claim 14 and further including the steps of connecting a switch means to energize said motor in respone to the sheet being retrieved; and, connecting a switch means to de-energize said motor after most of the sheet has passed through the rollers;

reducing the diameter of one of the rollers at a medial part thereof to form a tunnel between the rollers; mounting one end of an elongated guide member on the feed side of the roller and extending the guide member through the tunnel and into contact with a vertical guide located on the discharge side of the rollers and thereby forming a switch which is opened when a sheet is forced therebetween.

16. The method of claim 14 and further including the steps of connecting a first and second switch means to said motor and to a power supply; connecting said second switch means to energize said motor when the sheet is retrieved and to de-energize said motor when most of the sheet has passed through the rollers; actuating said first switch means in timed sequence with the position of the sheet to provide a current flow path from a the power supply, and to the motor, when the second switch means is open in order to continue the current flow to the motor until the sheet has almost cleared the rollers.

17. The method of claim 14 and further including the steps of guiding said sheet into the rollers by an elongated switch arm attached to the main frame at the feed side of the rollers; reducing a medial portion of one of the rollers to form a tunnel between said rollers through which said elongated switch arm extends into contact with a vertical guide and thereby forms a pair of switch contacts therewith; receiving the sheet between the arm and vertical guide and thereby open the contact therebetween; and connecting a second switch to provide a current flow path to the first switch and another current flow path that circumvents the first switch means so that when the sheet is removed from the first switch, current flows through the second switch and to the motor.

* * * * *

UNITED STATES PATENT AND TRADEMARK OFFICE

CERTIFICATE OF CORRECTION

PATENT NO. : 4,981,235

DATED : January 1, 1991

INVENTOR(S) : Michael G. Ferrini et al

It is certified that error appears in the above-indentified patent and that said Letters Patent is hereby corrected as shown below:

Column 4, line 16, insert --is-- after "46"
line 19, insert --B-- after "5"

Column 5, line 54, insert --and-- after "available"

Signed and Sealed this

Twenty-fifth Day of January, 1994

*Attest:*

Bruce Lehman

BRUCE LEHMAN

*Attesting Officer*

*Commissioner of Patents and Trademarks*